United States Patent [19]

Peterson et al.

[11] Patent Number: 4,758,050

[45] Date of Patent: Jul. 19, 1988

[54] STRIPPING MACHINE CUTTER FINGER ASSEMBLY

[75] Inventors: Clayton R. Peterson, San Clemente; James E. Ward, Glendora, both of Calif.; Leo Swan, Jefferson, Md.

[73] Assignee: Equipment Development Co., Inc., Frederick, Md.

[21] Appl. No.: 29,780

[22] Filed: Mar. 25, 1987

Related U.S. Application Data

[63] Continuation-in-part of Ser. No. 628,235, Jul. 6, 1984, Pat. No. 4,668,017.

[51] Int. Cl.[4] ..... E21C 25/16

[52] U.S. Cl. ..... 299/39; 299/89; 299/92

[58] Field of Search ..... 299/34, 36, 37, 41, 299/39, 88, 89, 25, 92; 51/177; 15/49 R, 93 R; 37/142 A, 142 R

[56] References Cited

U.S. PATENT DOCUMENTS

| | | | |
|---|---|---|---|
| 1,932,319 | 10/1933 | Myers | 51/177 |
| 2,713,757 | 7/1955 | Brennecke | 51/177 |
| 4,186,967 | 2/1980 | Kuhmonen | 299/25 |
| 4,295,274 | 10/1981 | Bricher et al. | 299/41 X |
| 4,614,380 | 9/1986 | Allen | 299/41 |
| 4,668,017 | 5/1987 | Peterson et al. | 299/37 |

*Primary Examiner*—Stephen J. Novosad
*Assistant Examiner*—Matthew Smith
*Attorney, Agent, or Firm*—Birch, Stewart, Kolasch & Birch

[57] ABSTRACT

There is disclosed herein a machine for removing coatings from uneven surfaces such as concrete and the like. The machine includes a power system for driving a pair of cutter head assemblies. The cutter head assemblies are rotated in opposite directions to help stabilize the machine and to throw the cuttings out of the way. Each cutter head assembly has a cutter head with a plurality of peripheral sides or facets and cutter bars are spring loaded thereon to allow cutting tools held by the cutter bars to effectively float on the concrete surface and follow uneven sections of the surface. The cutter head assemblies are mounted on the machine so that they can tilt forward and backward and from side to side to facilitate the cutter head assemblies following uneven surfaces. In one embodiment, a plurality of cutter bars are pivotally mounted on the peripheral faces of each cutter head; in another embodiment cutter pads with diamond bits are spring loaded and extend from the bottom surface of the cutter head; and in other embodiments, cutter fingers are either pivotally mounted to the peripheral faces of the cutter head or mounted for reciprocating movement in slots formed in the faces.

7 Claims, 4 Drawing Sheets

STRIPPING MACHINE CUTTER FINGER ASSEMBLY

This application is a continuation-in-part of application Ser. No. 628,235, filed July 6, 1984 U.S. Pat. No. 4,668,017

SUMMARY OF THE INVENTION

The present invention relates to cutting machines, and more particularly to a stripping machine employing cutting heads for removing coatings from uneven concrete surfaces.

Various techniques and forms of machines and devices have been developed for removing coatings from concrete surfaces and the like. Examples of such coatings are urethane and elastomeric coatings for parking decks and the like, vinyl type floor coverings, and mastics and other types of adhesives used to glue down carpet and other floor coverings. Among the techniques and devices for removing such coatings are simple scraping tools, heat or chemical removing devices or techniques, and sanding or grinding machines which cut or grind away the coating. One particular problem encountered in removing coatings from concrete surfaces is the fact that such surfaces inherently are not absolutely flat, and cutting or grinding devices cut too much off of high spots and remove too little from low spots.

A stripping machine according to the present invention includes a machine which drives a pair of cutter head assemblies each having a cutter head and a plurality of spring biased cutters or bits which can move up and down to follow uneven surfaces. The cutter head assemblies are mounted on the machine so that these assemblies also can pivot and tilt. Two cutter heads preferably are employed with each cutter head having a plurality of peripheral faces or facets, such as eight, so that the two heads can be arranged together and rotated to provide an overlapping cutting pattern. In this manner, the stability of the stripping machine is improved without requiring the use of three or more heads to achieve the overlapping cutting pattern and appropriate machine stability.

Accordingly, it is the principal object of the present invention to provide an improved form of cutting machine.

Another object of this invention is to provide a stripping machine employing cutter heads having a plurality of peripheral faces for allowing two or more cutter heads to be disposed in an adjacent manner for providing overlapping cutting patterns.

Another object of this invention is to provide a stripping machine employing a pair of multifaceted cutting heads, each having a plurality of spring biased cutters for facilitating stripping material from uneven surfaces.

These and other objects and features of the present invention will become better understood through a consideration of the following description taken in conjunction wiwth the drawings in which.

Figure 3:
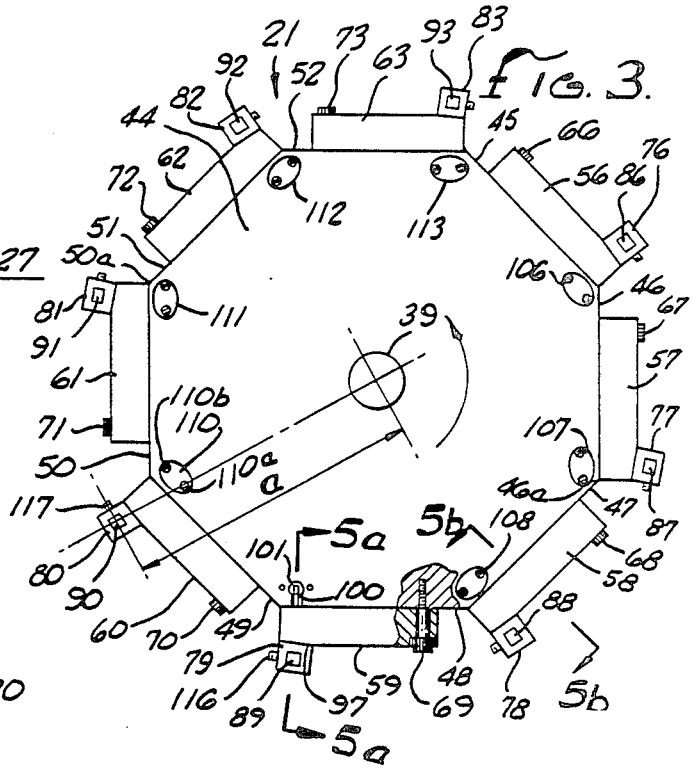
FIG. 3 is a top plan view of a cutter head assembly of the machine.
Figure 5A:
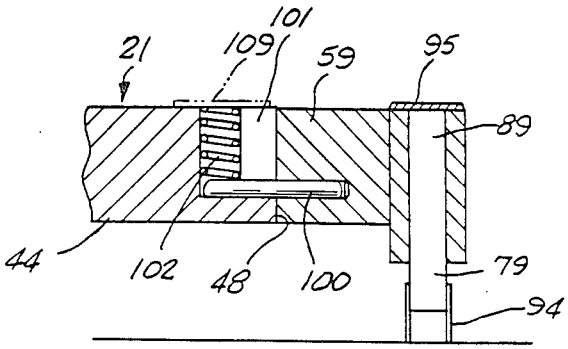
Figure 6:
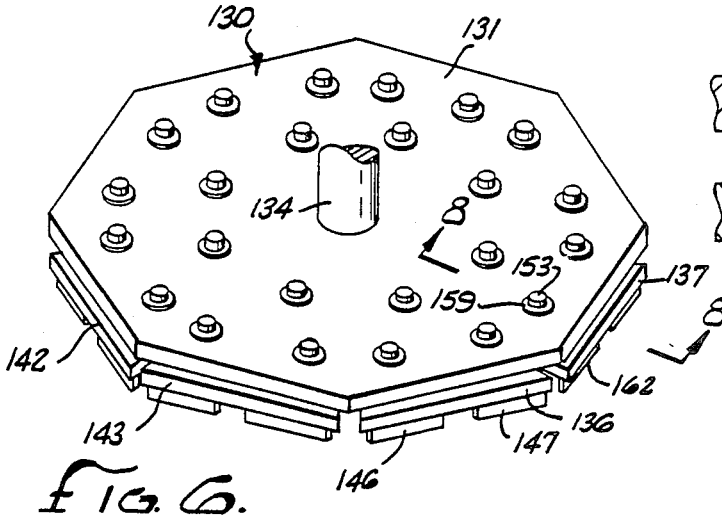
Figure 8:
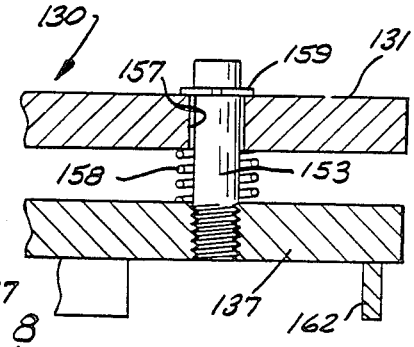
Figure 7:
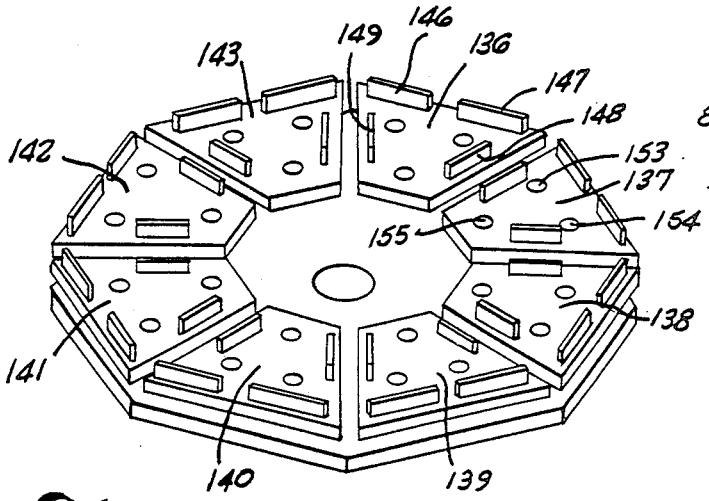
Figure 5B:
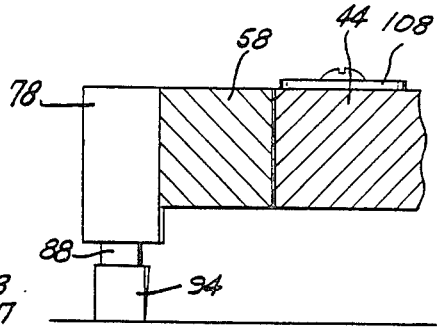
Figure 10:
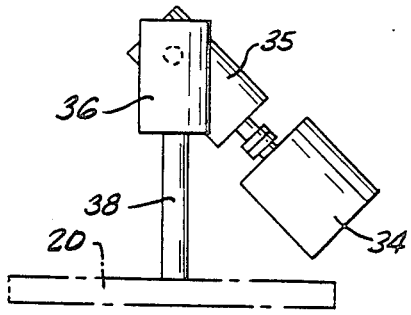
Figure 9:
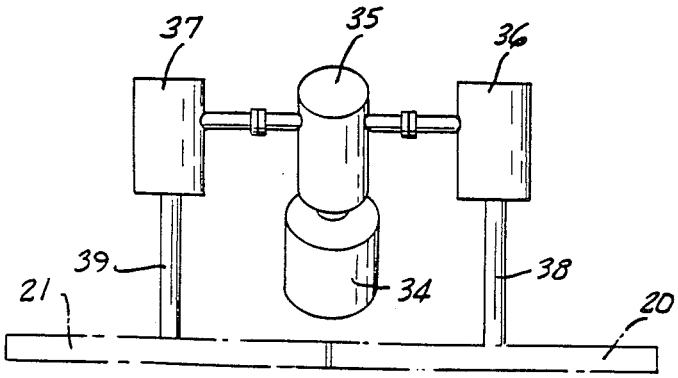
Figure 11:
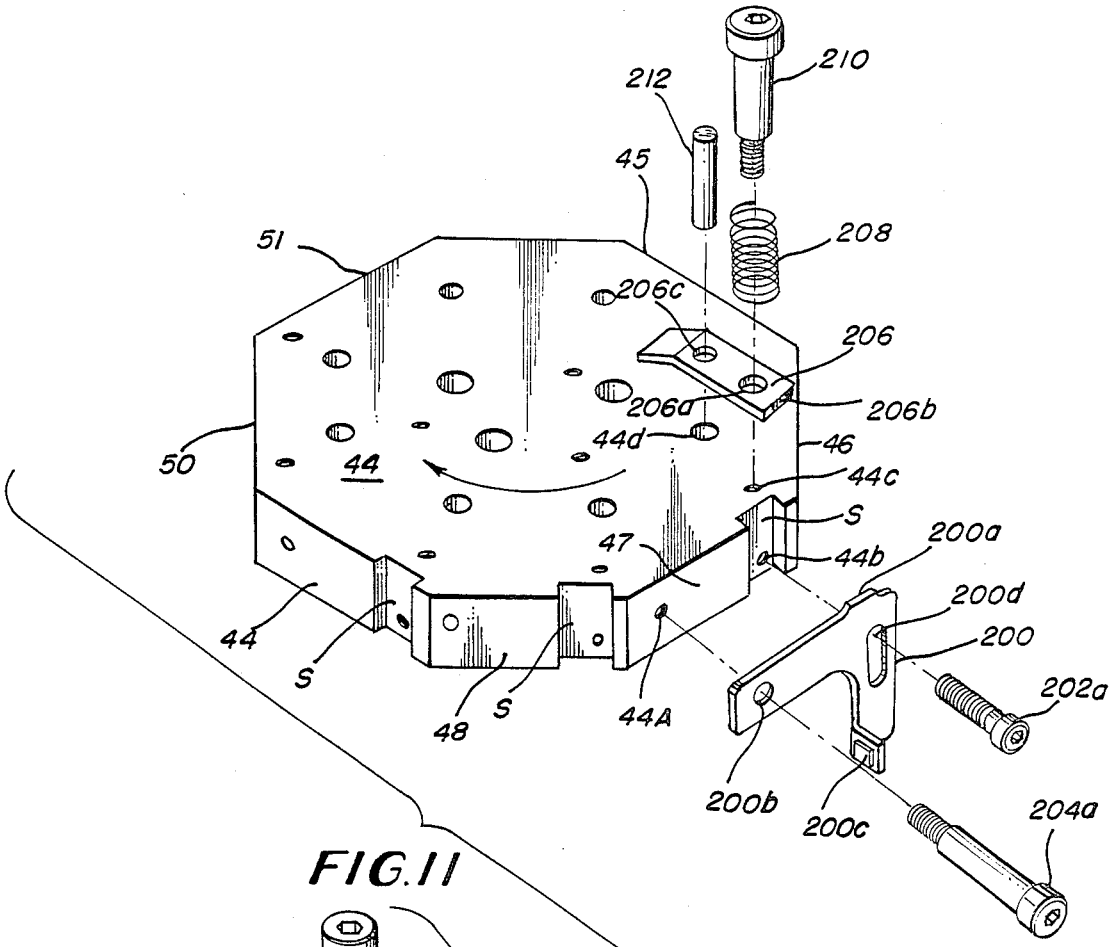
Figure 12:
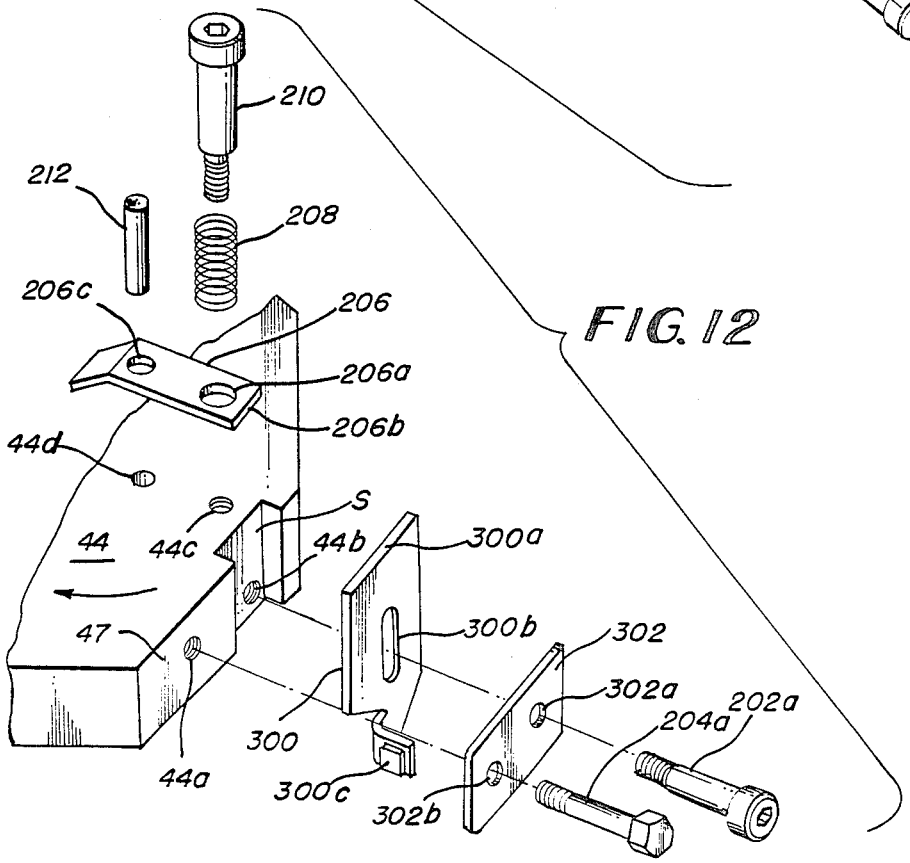
Figure 13:
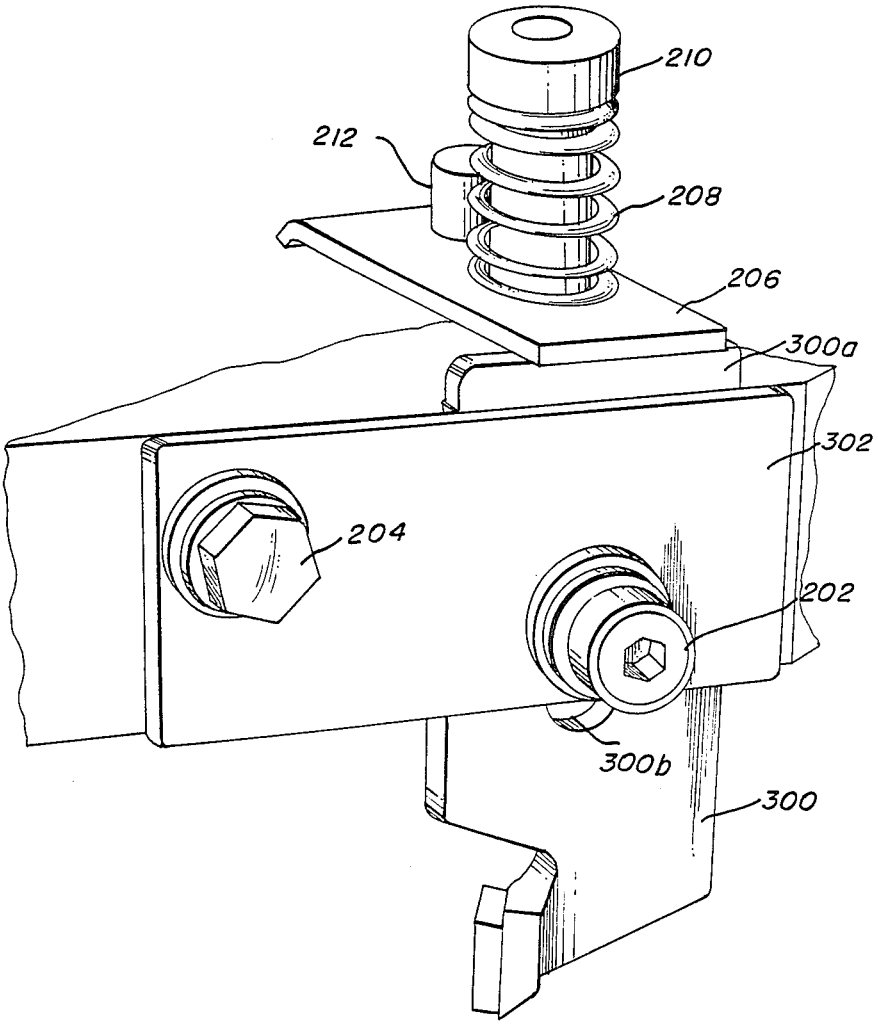

FIGS. 5*a* and 5*b* are cross-sectional views taken along lines 5*a*—5*a* and 5*b*—5*b* of FIG. 3;

FIG. 6 is a top perspective view of an alternative form of cutter head assembly using diamond bits;

FIG. 7 is a bottom perspective view of the cutter head assembly of FIG. 6;

FIG. 8 is a cross-sectional view taken along line 8—8 of FIG. 6;

FIGS. 9 and 10 are diagrammatic views illustrating a hydraulic motor and gear drive assembly for driving the cutter head assemblies of the present invention;

FIG. 11 is an exploded view of another form of a cutter head assembly and pivotable cutter fingers therefor; and FIGS. 12 and 13 are exploded views of still another form of cutter fingers mounted for reciprocating movement in the cutter head assembly of FIG. 11.

DETAILED DESCRIPTION OF PREFERRED EMBODIMENTS

Figure 1:
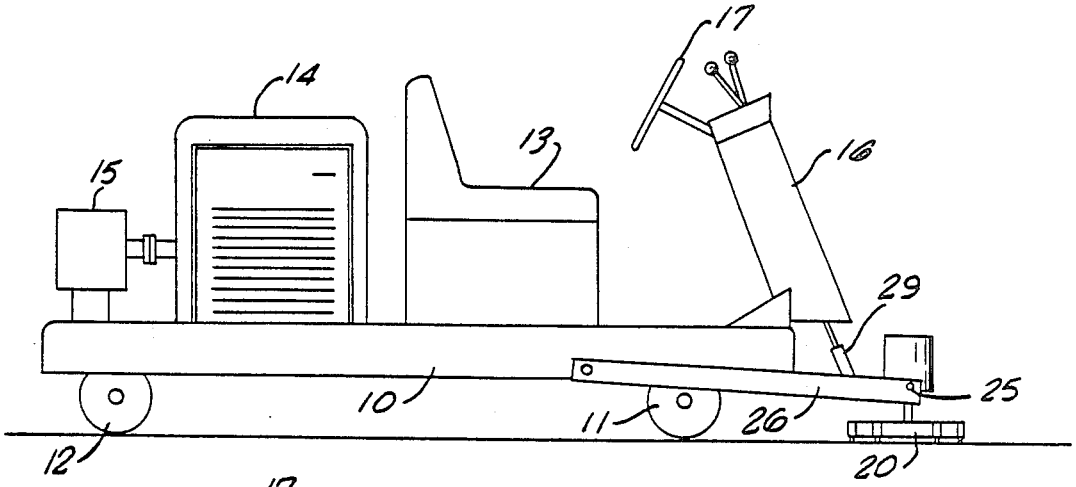
FIG. 1 is a side elevational view of a stripping machine according to the present invention.
Figure 2:
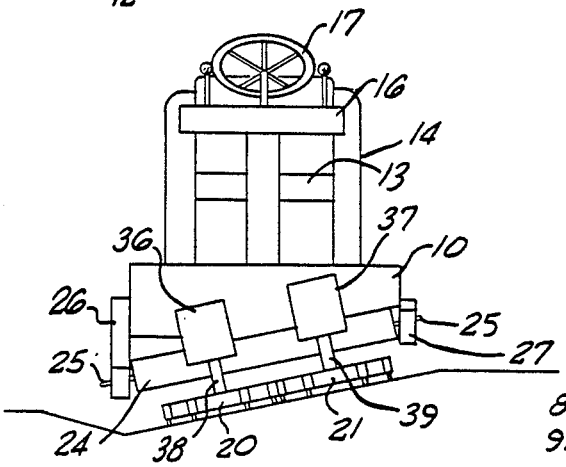
FIG. 2 is a front elevational view thereof.

Turning now to the drawings, and first to FIGS. 1 and 2, a stripping machine according to the present invention is shown generally comprising a base or body 10 mounted on a plurality of wheels 11–12, and which includes a driver's seat 13, power source 14, hydraulic pump 15, control console 16 and steering wheel 17. More particularly, the stripping machine comprises a pair of cutter head assemblies 20 and 21 suitably mounted on a support arm 24 to allow these assemblies 20–21 to pivot aout pivots 25 in a backward and forward direction, and mounted on a pair of control arms 26–27 to allow the cutter head assemblies 20–21 to tilt from side to side as seen in FIG. 2 and to be raised up and down under control of a hydraulic cylinder 29. The hydraulic cylinder also is used to supply downward pressure to the cutter assemblies 20–21.

The drive system for the cutter head assemblies 20–21 is only diagrammatically illustrated in FIGS. 1–2, but is shown in greater detail in FIGS. 9–10. In an exemplary embodiment, a hydraulic motor 34 is provided which is connected through a "tee" gear box 35 to a pair of right angle gear boxes 36–37 and to respective drive shafts 38–39 which rotate the cutter head assemblies 20–21. The power source 14 in a typical stripping machine as seen in FIGS. 1–2 may comprise a thirty horsepower engine for driving the hydraulic pump. Smaller and larger machines can be built using smaller or larger power sources. For example, a portable hand controlled stripping machine can use a relatively small gasoline engine or electric motor for driving the hydraulic pump.

Turning now to a more detailed description of the cutter head assemblies, both of the assemblies 20 and 21 are identical, and only the cutter head assembly 21 is shown in detail in FIGS. 3 and 5. The cutter head assembly 21 comprises a cutter head 44 having a plurality of peripheral faces or facets, such as eight, 45 through 52. Cutter bars 56–63 are pivotally mounted on the respective faces 45–52 by means of pivot bolts 66–73. The cutter bars 56–63 have affixed thereto respective tool holders 76–83 which carry respective cutter tools 86 through 93, and the cutter tools preferably each include a carbide insert, with carbide insert 94 being seen in detail in FIG. 5*b*.

Each of the cutter bars 56–63 is spring biased in a downward direction by means of a suitable spring assembly, one of which is shown in detail in FIG. 5*a*. This spring assembly comprises a cutter bar pin 100 disposed in an opening toward the trailing end of the cutter bar 59, and the inner end of the pin 100 extends into a slot 101 which opens out to the face 48. A spring 102 is disposed in the slot 101 and is retained in place by a spring plate 109 (note the spring plates 106–108 and 110–113 in FIG. 3 as well as the plate 109 in FIG. 5). These spring plates are retained on the screws (note screws 110*a* and 110*b* in FIG. 3), and these screws can be tightened or loosened to provide a tension adjustment for the cutter bars.

Each of the cutter tools is retained in the tool holder by a suitable set screw (note, for example, set screws 116 and 117 in the tool holders 79–80 in FIG. 3). A cover 95 (see FIG. 5*a*) can be provided at the top of each tool holder to help retain the cutter tool if desired. The cutter tools are readily removable for replacement as needed.

The structure of the cutter head assemblies allows the cutter bars 56–63 topivot up and down about the pivot bolts 66–73 under spring pressure so as to allow the cutter tools to "float" and follow the uneven contour of a concrete surface. The articulated support arm 24 and control arms 26–27 allow the cutter tool assemblies 20–21 to follow gross or major unevennesses of the concrete surface, and the pivoted cutter bars allow the cutter tools to follow the small or minor unevennesses in the concrete surface.

Figure 4:
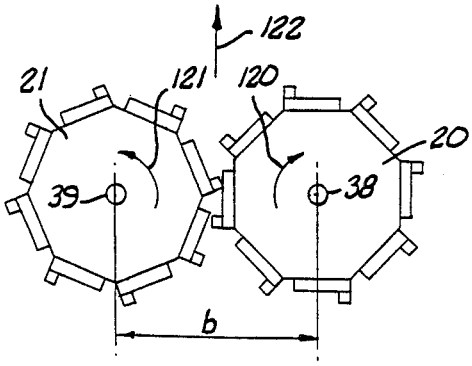
FIG. 4 is a diagram illustrating the manner in which a pair of cutter head assemblies are disposed and rotated to provide an overlapping cutting pattern.

FIG. 4 shows the counter or opposite rotation pattern of the cutter head assemblies 20–21, and they rotate preferably in the directions indicated by arrows 120–121 which facilitates throwing the cuttings and debris out of the way as the machine of FIGS. 1–2 moves forward in the direction indicated by the arrow 122 in FIG. 4. The spacing of the drive shafts 38 and 39 of the cutter head assemblies 20 and 21, as indicated by the space "b" in FIG. 4 is chosen to allow the cutter tools to slightly overlap (such as one half inch) as the cutter head assemblies 20 and 21 rotate, but is sufficiently long to prevent the tool holders and cutter bars from touching or hitting each other. This overlap of the cutting patterns is made possible by the use of the multiple faces, preferably eight, 45–52, and this arrangement allows two cutter head assemblies 20–21 to be used on the machine, whereas three such assemblies would be required to get overlapping cuts if no such overlapping pattern wre provided. It will be noted that the tool holders 76–83 are mounted at a slight angle (note 97 in FIG. 30) with the cutting edge on a radial line so as to provide an appropriate circular cut.

As an example of size of the cutter head, the same may be sixteen inches from corner to corner (e.g., from corner 46*a* to corner 50*a*). The cutter bars may be approximately five inches long, and the width of these bars and the tool holders may be approximately one inch. The cutter head assemblies 20 and 21 are rotated at an appropriate speed depending upon the material to be stripped and the forward speed of the stripping machine.

Turning now to the embodiment of FIGS. 6–8, one cutter head assembly 130 is shown which also comprises a multiface (e.g., eight) cutter head 131. Instead of the pivoted cutter bars of the embodiment of FIG. 3, the cutter head assembly 130 comprises a plurality of spring biased cutter pads 136–143 on which are mounted a plurality of diamond bits. For example, the cutter pad 136 has four diamond bits 146–149 suitably affixed to the pad and extending downwardly. The cutter head 131 is mounted onto and driven by a drive shaft 134.

Each of the cutter pads 136–143 is secured to a plurality of mounting pins, such as pins 153 throught 155 secured to the pad 137. FIG. 8 is a cross-sectional view which shows the details of the mounting of one pin 153 to the pad 137. The lower end of the pin 153 is threaded into the pad 137, and the upper end of the pin 153 extends upwardly through an opening 157 in the cutter head 131. A coil spring 158 is disposed between the pad 137 and the bottom surface of the cutter head 131, and the assembly of the pad 137, pin 153 and spring 158 is retained onto the cutter head 131 by a clip ring 159 clipped onto the top of the pin 153 as best seen in FIGS. 8 and 6. This arrangement allows the cutter pads 136–143 to move up and down against the force of the associated springs so as to allow the cutter head assembly 130 to follow the uneven surface being stripped. As is the case with the arrangement of FIGS. 1–3, two of the cutter head assemblies 130 of FIGS. 6–8 are mounted on shafts and driven in the same manner described in connection with the previous embodiment. Either embodiment can be used also to break the surface of concrete for better adhesion of various coatings.

Referring to FIG. 11, there is illustrated an alternative form of a cutter head assembly suitable for use with the stripping machine of the present invention. The cutter head 44 is illustrated therein as before with a plurality of peripheral faces or facets, such as 8, 45 through 52. However, each of the faces has a slot S formed therein for reasons to become apparent hereinafter with refernce to FIGS. 12 and 13. Each of these faces have a cutter strip finger 200 pivotally mounted thereon about a threaded pivot pin 204 threaded into aperture 44*a* which passes through an aperture 200*b* in the end of one arm of the L-shaped cutter finger 200. Cutter finger 200 also has a projection 200A. A bolt 202 is provided to extend through a slot 200*d* into an aperture 44*b* of each cutter face to stabilze the cutter fingers with respect to the faces of the cutter head. Slot 200*d* is wide enough to permit finger 200 to pivot about pin 204.

A spring biasing assembly is mounted to the upper face of the cutter head 44 and includes a retainer 206 having an end 206*b* for operatively engaging the projection 200*a* of the cutter finger 200. Retainer 206 also has an aperture 206*a* through which an adjustable screw pin 210 passes into an aperture 44*c* to hold a coil compression spring 208 against the upper surface of retainer 206. The coil spring 208 is held in place by adjustable screw pin 210 and will spring bias the dutter blade 200*c* within cutter finger 200 down against the floor surface which is being stripped via the engagement between downwardly extending end 200*b* and projection 200*a* of the cutter finger 200. A positioning roll pin 212 is also provided through an aperture 300*c* and into an aperture 44*d* in the top surface of cutter head 44.

It can be seen that as the cutter head 44 rotates in the direction indicated in FIG. 11, cutter blades 200*c* disposed at the trailing ends of each face will ride along the floor surface, and any uneven portions of the floor will force blade 200*c* up or down either in opposition to the force of coil spring 208 or in the same direction as the spring force. Accordingly, it can be seen that the pivoted cutter fingers 200 allow the cutter blades 200*c* to follow any unevenness in the concrete surface being stripped, in a similar fashion to the cutter bar assemblies illustrated in FIGS. 1 and 5*a*.

The cutter fingers of FIG. 11 are particularly effective on surfaces having a large degree of unevenness since the fingers are free to pivot about pins 204 to follow bumps or depressions in the floor or surface being stripped. However, if the floor to be stripped or finished requires heavy-duty scraping, the cutter finger assembly illustrated in FIGS. 12 and 13 is more suitable. As illustrated in FIGS. 12 and 13, the cutter head 44 has the same structure as in the FIG. 11 embodiment inclusive of slots S formed in each of the peripheral faces 45 through 52. While the slots S are bridged by the cutter finger 200 in the FIG. 11 embodiment and are, therefore, not really needed with cutter fingers 200, slots S are operative parts of the cutter finger assembly of FIGS. 12 and 13. As illustrated, slots S are dimensioned to accommodate cutter fingers 300 which are mounted for reciprocating motion within the slots in vertical directions with respect to cutter head 44. Cutter fingers 300 each include a slot 300*b*, a top edge 300*a* and a cutter blade 300*c*, such as a Tungsten Carbide or Diamond cutter blade. a retainer plate 302 fits over the cutter fingers 300 and traps the same within the slots S by means of bolts 204 and threaded socket screw 202*a*. Hex head bolt 204*a* fits through aperture 302*b* and is screwed into a threaded socket 34*a* in each face, such as 47, of the cutter head 44. Threaded screw 202*a* fits through an aperture 302*a* in plate 302 and elongated slot 300*b* in cutter finger 300 into a threaded aperture 44*b* in slot S. The compression spring 208 and the associated retainer plate 206 are mounted to the cutter head 44 in a similar manner to that described in connection with the embodiment of FIG. 11, and function in substantially the same way, to provide spring bias to cutter fingers 300 via the interaction between front edge 206*b* of the retainer bracket 206 and upper edge 300*a* of cutter fingers 300. As with the embodiment of FIG. 11, the cutter fingers 300 are positioned at each trailing end of the peripheral faces of the cutter head 44, referenced to the direction of rotation of the cutter head indicated by the arrow. The cutter assembly of FIGS. 12 and 13 is slightly more durable than the cutter finger assembly of FIG. 11 and, therefore, more suitable for making heavy-duty or rough stripping operations of concrete surfaces.

However, it can be seen, due to the universal nature of the cutter head 44 inclusive of slots S and the respective threaded apertures 44*a* and 44*b*, that either cutter finger assembly including cutter fingers 200, or fingers 300, may be attached to cutter head 44, depending on the nature of the stripping task required. Therefore,the two cutter finger assemblies of the present invention in conjunction with the cutter head structure provide for great versatility in the use of the stripping machine.

While presently preferred embodiments of the present invention have been illustrated and described, modifications and variations thereof will be apparent to those skilled in the art given the teachings herein, and it is intended that all such modifications and variations be encompassed within the scope of the appended claims.

What is claimed is:

1. In a stripping machine for removing coatings from uneven concrete surfaces and the like and wherein the stripping machine includes a body for supporting at least one cutter head assembly and means for supplying motive power to the assembly, the improvement comprising:

cutter head means having top and bottom major surfaces and a plurality of peripheral faces between the top and bottom major surfaces;

cutter finger means pivotally mounted to each peripheral face for rotation about axes orthogonal to said faces, said cutter finger means having an upper edge and a bottom edge with a cutter blade retained within said bottom edge;

retainer means having a first distal end pivotally mounted on the top major surface of said cutter head means, said retainer means having a second distal end extending radially outwardly beyond each peripheral face over the top edge of each cutter finger; and spring biasing means for pressing said second distal end of said retainer means against said top edges of said cutter fingers for biasing said cutter blades against the surface being stripped.

2. A stripping machine according to claim 1 wherein each said retainer means has first and second apertures therein between said first and second distal ends, the aperture adjacent said first distal end receiving a pin extending vertically from the top major face of said cutter head, the aperture adjacent said second distal end receiving the shank portion of an adjustable screw with a head thereon, said spring biasing means comprising a coil spring disposed around the shank portion of said screw and compressed between said head and said retainer means, whereby said retainer means can rock about said pin and screw as said cutter blades move across the surfaces being stripped.

3. In a stripping machine for removing coatings from uneven concrete surfaces and the like and wherein the stripping machine includes a body for supporting at least one sutter head assembly and means for supplying motive power to the assembly, the improvement comprising:

cutter head means having top and bottom major surfaces, a plurality of peripheral faces between the top and bottom major surfaces, and a slot in each peripheral face;

cutter finger means disposed in each slot for reciprocating movement therein in directions orthogonal to the top and bottom major surfaces of the cutter head means, said cutter finger means having an upper edge and a bottom edge with a cutter blade retained within the bottom edge;

retainer means having a first distal end pivotally mounted on the top major surface of said cutter head means, said retainer means having a second distal end extending radially outwardly beyond each peripheral face over the top edge of each cutter finger; and spring biasing means for pressing said second distal ends of said retainer means against said top edges of said cutter fingers for biasing said cutter blades against the surface being stripped.

4. a stripping machine according to claim 3 wherein each said retainer means has first and second apertures therein between said first and second distal ends, the aperture adjacent said first distal end receiving a pin extending vertically from the top major face of said cutter head, the aperture adjacent said second distal end receiving the shank portion of an adjustable screw with a head thereon, said spring biasing means comprising a coil spring disposed around the shank portion of said screw and compressed between said head and said retainer means, whereby said retainer means can rock about said pin and screw as said cutter blades move across the surfaces being stripped.

5. A stripping machine according to claim 3 further including plate means for holding said cutter finger means in each said slot, said plate means being secured to each peripheral face with screws, one of said screws passing through an elongated slot in said cutter fingers to thereby permit said reciprocating movement of said cutter fingers.

6. A stripping machine according to claim 1 including two adjacent cutter head means which rotate in opposite directions.

7. A stripping machine according to claim 3 including two adjacent cutter head means which rotate in opposite directions.

* * * * *